United States Patent [19]

Marino

[11] 4,379,589

[45] Apr. 12, 1983

[54] RECLINABLE CHAIR

[75] Inventor: Mariō H. S. Marino, Buenos Aires, Argentina

[73] Assignee: Interieur Forma S.A., Capital, Argentina

[21] Appl. No.: 192,818

[22] Filed: Oct. 1, 1980

[51] Int. Cl.[3] ..... A47C 3/00

[52] U.S. Cl. ..... 297/299; 297/454; 248/621

[58] Field of Search ..... 297/454, 285–300; 248/628, 632, 634, 618, 621; 267/140.4

[56] References Cited

U.S. PATENT DOCUMENTS

| | | | |
|---|---|---|---|
| 181,360 | 8/1976 | Osgood | 248/628 |
| 275,910 | 4/1883 | Hill | 248/621 X |
| 1,382,702 | 6/1921 | White | 297/293 X |
| 1,500,338 | 7/1924 | Shuman | 297/454 |
| 1,886,308 | 11/1932 | Schultes | 297/285 |
| 2,183,564 | 12/1939 | Hart | 297/300 X |
| 2,224,648 | 12/1940 | Haadem | 267/140.4 |
| 4,159,146 | 6/1979 | Braconnier | 297/285 |

FOREIGN PATENT DOCUMENTS

| | | | |
|---|---|---|---|
| 2909934 | 3/1980 | Fed. Rep. of Germany | 267/140.4 |

*Primary Examiner*—Francis K. Zugel

*Attorney, Agent, or Firm*—Robert Scobey

[57] ABSTRACT

A reclinable chair having a back and seat articulated for reclining movement of the back with respect to the seat, in which a plate having opposed faces disposed at an angle with respect to each other joins together the back and the seat. One of the plate faces is joined to the back, while the other of the plate faces is joined to the seat. A restoring force is exerted by the plate tending to restore the plate faces to the angle therebetween when they are forced away from that angle. The plate is preferably U-shaped, substantially encased in resilient material also U-shaped, with a flap of resilient material extending parallel to and between the legs of the plate.

4 Claims, 2 Drawing Figures

RECLINABLE CHAIR

BACKGROUND AND BRIEF DESCRIPTION OF THE INVENTION

The present invention relates to a reclinable chair, particularly one in which the back and seat are articulated for reclining movement of the back with respect to the seat. The invention provides a simple but highly effective reclining control element disposed between the back and the seat of a chair.

Reclining control mechanisms for seats and backs of chairs are known, which present various inconveniences and problems. One of the more generally used reclining control elements basically works by friction between two plates of wrinkled surfaces, the friction between which is regulated by means of a butterfly. This type of control mechanism suffers from excessive wear, and in time loses its properties of support, resulting in a weakened back structure in the chair. Other types of reclining control mechanisms utilize springs, acting in compression or tension. Both these types of reclining control mechanisms are complex, due generally to the many parts that are included, rendering them not only expensive but also large in size, not pleasing in appearance, and also noisy in operation.

An object of the present invention is to overcome these problems of prior art reclining control mechanisms, and to provide a control mechanism which is pleasing in appearance, quiet in operation, and effective in its control of reclining in a chair. Another object is to provide a reclining control mechanism which is simple in construction, presenting no problems in installation or removal.

These objects are achieved through the present invention by utilizing a plate, preferably of spring steel, having opposed faces disposed at an angle with respect to each other. One of the faces of the plate is joined to the back of the chair, while the other face is joined to the chair seat. A restoring force is exerted by the plate tending to restore the plate faces to the angle therebetween whenever they are forced away from that angle.

A particularly suitable form of plate is U-shaped, and is substantially encased in resilient, preferably elastomeric, material which is also U-shaped. The resilient material may include a flap extending parallel to and between the encased legs of the plate. Preferably the legs of the U-shaped plate define an angle less than about 110° with the mid-portion of the U-shaped plate.

The invention will be more completely understood by reference to the following detailed description.

DETAILED DESCRIPTION

Figure 1:
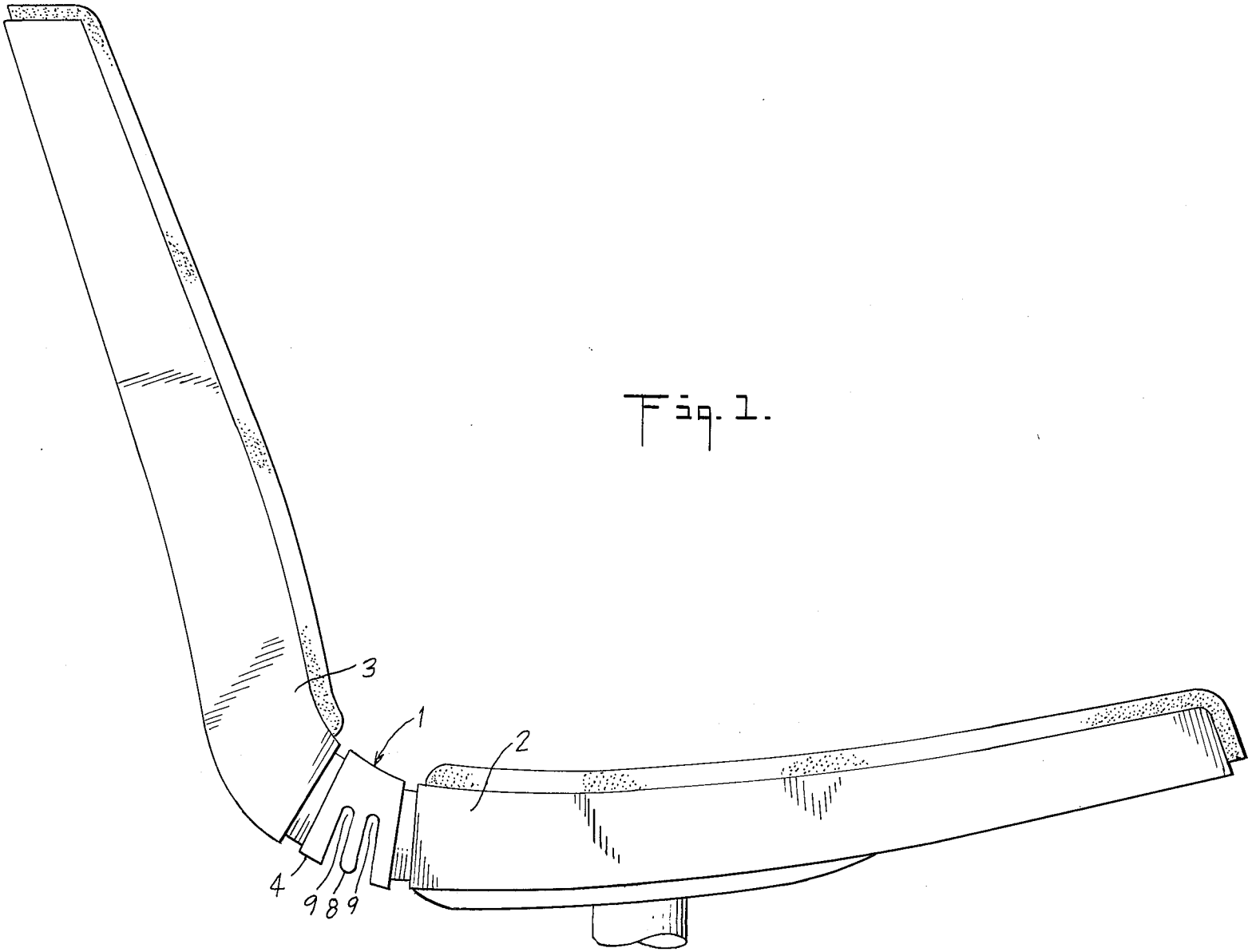
FIG. 1 is a side view of a chair seat and back joined together by a reclining control element embodying the invention.
Figure 2:
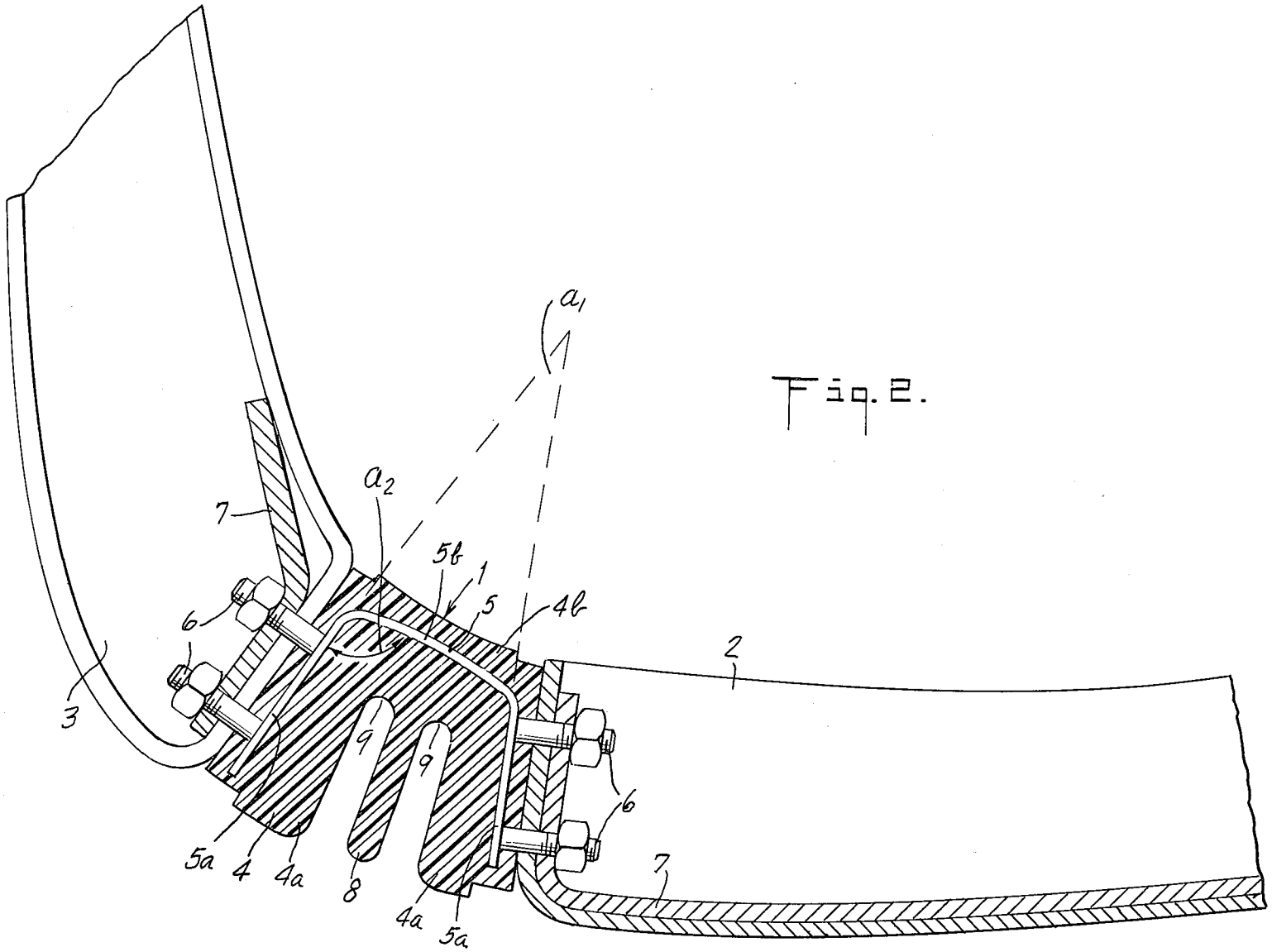
FIG. 2 is a transverse sectional view of the chair of FIG. 1, taken to an enlarged scale, showing the details of the reclining control element of FIG. 1.

Referring to FIGS. 1 and 2, reclining control element 1 is constituted by a plate 5, preferably of spring steel and preferably U-shaped in section, secured by threaded screws 6 with appropriate nuts to back 3 and seat 2 of a chair. Plate 7 may be utilized, as shown, to reinforce the structure of the chair. The plate 5 is substantially encased by resilient material 4, preferably elastomeric material.

As noted, the plate 5 is preferably U-shaped, and includes opposed legs 5*a* disposed at an angle with respect to each other (that angle is designated in FIG. 2 as $a_1$. The U-shaped plate 5 also includes a mid-portion 5*b*, and each leg 5*a* of the plate defines an angle which is less than about 110° with the mid-portion 5*b* of the plate. This latter angle is designated as $a_2$ in FIG. 2. As is apparent from FIG. 2, it is the legs 5*a* of the plate that are joined to the back 3 and seat 2 of the chair.

As also noted above, the plate 5 is substantially encased by resilient material 4. That resilient material is also generally U-shaped, and legs 4*a* thereof encase the legs 5*a* of the plate, while mid-portion 4*b* of the resilient material encases mid-portion 5*b* of the plate. The resilient material includes a flap or projection 8, essentially formed from the resilient material by slots 9 which outline the flap or projection. The flap 8 extends parallel to and between the legs 4*a* of resilient material.

A reclining control element of the type shown in FIG. 2 is particularly suitable for control of reclining of the back portion 3 of the chair with respect to the seat 2. The material of the plate 5 exerts a restoring force tending to restore the faces 5*a* of the plate to the angle $a_2$ with respect to the plate portion 5*b* whenever that angle is changed due to a person sitting in the chair and a reclining of the back 3 with respect to the seat 2 taking place. The resilient material 4 contributes to this action.

It will be apparent to those skilled in the art that modifications to the embodiment of the invention described above may be made. Accordingly, the description above should be considered as illustrative, and the invention should be taken to be defined by the following claims.

I claim:

1. In a reclinable chair having a back and a seat articulated for reclining movement of the back with respect to the seat, the improvement comprising a generally U-shaped plate having opposed legs disposed at an angle with respect to each other, one of said legs being joined to said back and the other of said legs being joined to said seat, the material of said plate exerting a restoring force tending to restore said legs to said angle when forced away from said angle, said plate being substantially encased by a resilient material generally U-shaped in section, with the legs of said plate being substantially encased within the legs of said U-shaped resilient material, and said resilient material includes a flap extending parallel to and between said legs of said resilient material.

2. A reclinable chair according to claim 1, in which said legs of said U-shaped plate define an angle less than about 110° with the mid portion of said U-shaped plate.

3. A reclinable chair according to claim 2, in which said plate is of spring steel.

4. A reclinable chair according to claim 3, in which said resilient material is elastomeric.

* * * * *